US007121540B2

(12) United States Patent
Machon et al.

(10) Patent No.: US 7,121,540 B2
(45) Date of Patent: Oct. 17, 2006

(54) METHOD AND DEVICE FOR THE MECHANICAL STITCHING OF MULTIPART PRINTING PRODUCTS BY MEANS OF WIRE STAPLES

(75) Inventors: Wolfgang Machon, Porta-Westfalica (DE); Holger Engert, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 09/930,647

(22) Filed: Aug. 15, 2001

(65) Prior Publication Data

US 2002/0043755 A1 Apr. 18, 2002

(30) Foreign Application Priority Data

Aug. 16, 2000 (DE) ..... 100 39 908.08

(51) Int. Cl.
*B42C 1/12* (2006.01)

(52) U.S. Cl. ..... 270/52.18; 270/58.08; 412/35; 227/100

(58) Field of Classification Search ..... 227/39, 227/44, 50, 99, 100, 154; 270/58.07, 58.08, 270/52.18; 412/35
See application file for complete search history.

(56) References Cited

U.S. PATENT DOCUMENTS 3,026,519 A * 3/1962 Johnson ..... 227/2
3,554,531 A * 1/1971 Heigl et al. ..... 270/58.17
3,884,408 A * 5/1975 Leiter et al. ..... 227/100
4,200,275 A * 4/1980 Wangermann ..... 270/52.23
4,478,398 A * 10/1984 Stobb ..... 270/52.18
4,519,599 A * 5/1985 Mayer ..... 270/52.18
4,533,132 A * 8/1985 Wangermann ..... 270/52.18
4,588,121 A * 5/1986 Olesen ..... 227/120
4,614,290 A * 9/1986 Boss ..... 227/1
5,100,118 A * 3/1992 Hobbs et al. ..... 270/52.17
5,108,244 A * 4/1992 Bellanca ..... 412/37
5,174,557 A * 12/1992 Meier ..... 270/38
6,206,358 B1 * 3/2001 Yamaguchi et al. ..... 270/52.02

FOREIGN PATENT DOCUMENTS

| | | |
|---|---|---|
| DE | 36 45 276 C2 | 1/1994 |
| DE | 34 43 376 C2 | 5/1995 |
| EP | 07 61 472 A1 | 3/1997 |
| EP | 09 58 942 A1 | 11/1999 |

OTHER PUBLICATIONS

German Search Report for DE 100 39 908.8.

* cited by examiner

*Primary Examiner*—Patrick Mackey
(74) *Attorney, Agent, or Firm*—Alix, Yale & Ristas, LLP

(57) ABSTRACT

A method and machine for stitching multipart printing products by means of wire staples (8, 26), in which the products (2, 22) are transported forwards continuously by a conveyer (4, 19, 23) and a wire staple (8, 26) is driven in by a stitching head (5, 25) with a displaceably guided staple-driver, at least one wire staple (8, 26) is driven, during the movement conveying the product (2, 22), into the product (2, 22), transversely to the direction of conveyance, by a stitching head (5, 25) positioned in a stationary manner. The staple-driver of the stitching head (5, 25) drives in the wire staple (8, 26) at such high speed that the wire staple (8, 26) penetrates the product (2, 22) substantially perpendicularly.

20 Claims, 3 Drawing Sheets

METHOD AND DEVICE FOR THE MECHANICAL STITCHING OF MULTIPART PRINTING PRODUCTS BY MEANS OF WIRE STAPLES

BACKGROUND OF THE INVENTION

The invention relates to a method and device for the mechanical stitching of multipart printing products by means of wire staples, in which the products are transported forwards continuously by a conveyer and a wire staple is driven in by a stitching head with a displaceably guided staple-driver.

For manufacturing laterally wire-stitched multi-quire paper covers in flowlines, use is made of side-stitching units as a component interlinked with a collating machine and an adhesive binding machine. Loose quires collated to form stacks are transferred into an upright position via a setting-up track and arrive, standing on their backs, in a connecting conveyer system with side-stitching units. These are equipped with two or four stitching heads with associated bending-over devices and are located, for the purpose of introducing the wire staples during the continuous transport of the products, on longitudinally displaceable, synchronously following carriages. For the purpose of sticking wire staples into thick products on both sides, additional stitching heads may be provided on the opposite side of the path of movement of the stacks of quires. The quires which are connected to form a block by laterally introduced wire staples are fed, as the process continues, to the adhesive binding machine for gluing the back and/or the side regions and for casing the block into a cover.

Paper covers saddle-stitched with wire, such as magazines, are produced in so-called "saddle-stitching flowlines" on gathering wire-stitching machines with the aid of a roof-shaped stitching-goods carrier with entrainment means on a continuously running gathering chain which engage behind the products, and with two or more stitching heads and associated bending-over devices for introducing wire staples through the back-margin fold and bending over the legs of the wire staples from inside. The stitching heads with the bending-over devices are located, just as in the case of lateral wire-stitching, on carriages which follow at the same speed. An example of a gathering wire-stitching machine of this kind is known from German Patent Specification 34 43 376.

The known block wire-stitching machines and gathering wire-stitching machines with stitching heads mounted in an overhung manner for use in flowlines require an extremely high outlay in terms of construction and are therefore very cost-intensive. Because of the masses which have to be moved, constituted by the carriage with the stitching heads, further limits are imposed on increases in performance. Moreover, stitching machines with carriages which are constantly moved to and fro are subject to major wear and also make not inconsiderable demands in terms of space.

SUMMARY OF THE INVENTION

The paramount object underlying the invention is therefore to provide, with simple, cost-effective means and in an extremely narrow space, the possibility, while avoiding the disadvantages of the prior art, of mechanically stitching multipart printing products by means of wire staples, the said products being transported forwards continuously by a conveyer and a wire staple being driven in by a stitching head with a displaceably guided staple-driver.

This is achieved by means of the invention in a surprisingly simple and economical manner through the fact that at least one wire staple is driven, during the movement conveying the product, into the said product, transversely to the direction of conveyance, by a stitching head positioned in a stationary manner, the staple-driver of the stitching head driving in the wire staple at such high speed that the said wire staple penetrates the product substantially perpendicularly.

According to a second paramount concept of the invention, the device is characterised by a conveyer which transports the products forwards continuously, and by a stitching unit with at least one stitching head which is orientated perpendicularly to the plane of transport, is positioned in a stationary manner at a defined distance from the products, has a magazine for holding bars of staples and has a displaceably guided staple-driver, which is preferably controlled via compressed air, for driving in wire staples during the conveying movement.

It can be seen that, by using stationary stitching heads whose staple-drivers drive the wire staples into the products at high speed, the invention has revealed a constructionally simple and economical way of joining multipart printing products during the continuous conveying movement by introducing wire staples. Underlying the invention is the knowledge that wire staples are driven in almost at right angles to the plane of a product which is moved relative to the stitching head, if the said wire staples are accelerated to a substantially higher speed than the speed at which the product is transported. In the case of a product 20 mm thick which is moved forwards at a speed of transport of 0.5 m/s, the divergence in the direction of transport amounts to a mere 0.4 mm if the wire staple is driven into the product at 25 m/s. In general, the staple is driven into the block at an average speed that is at least ten times, preferably 25 times, the block conveying speed.

BRIEF DESCRIPTION OF THE DRAWINGS

The invention will be explained in greater detail below with the aid of exemplified embodiments represented in the drawings. In perspective representations.

DESCRIPTION OF THE PREFERRED EMBODIMENTS

Figure 1:
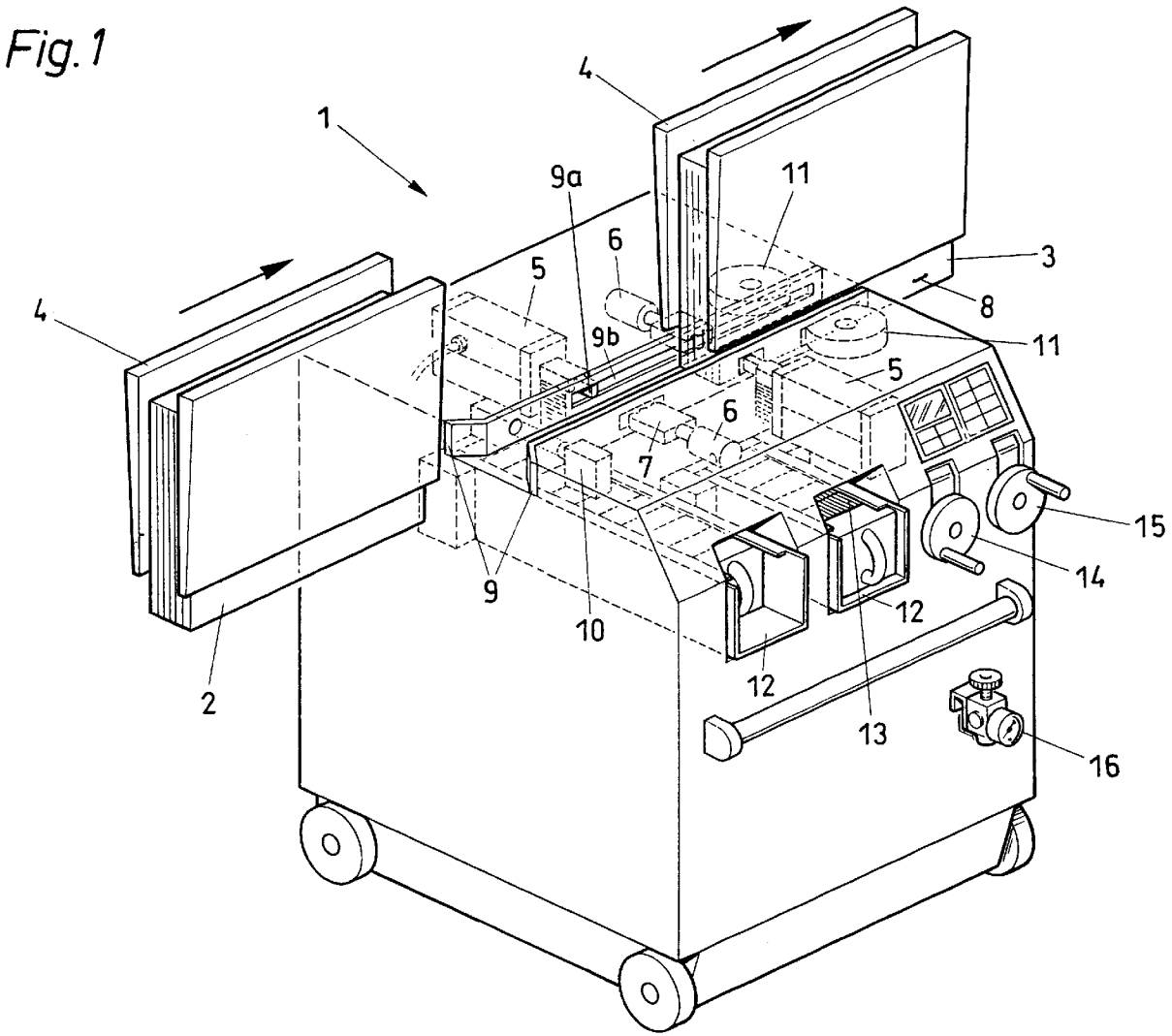
FIG. 1 shows a side-stitching unit as an interchangeable module for a bookbinding machine with clamps which are driven in a circulating manner as the book-block transport system.

The stitching unit 1 shown in FIG. 1 is intended as an interchangeable module for a bookbinding machine which will be referred to below as an "adhesive binder" and in which stacks of quires 2 are connected to form book blocks 3 and, in the process, are transported forwards continuously in transport clamps 4 which are driven in a circulating manner. In the variant shown here, a pneumatic stitching head 5 is disposed on each of the opposing sides, the said heads being mutually offset in the direction of transport of the stacks of quires 2. A bending-over device 7 which can be controlled via a pneumatic cylinder 6 is associated with each of the stitching heads 5, opposite the latter. With this arrangement it is possible to connect, so as to form book blocks 3 by side stitching, both thin stacks of quires 2, with the aid of wire staples 8 passing through the latter and bent over on the rear side, and also thick stacks of quires 2, with the aid of wire staples 8 introduced from both sides and engaging in one another.

The stacks of quires 2, which are held in a clamped manner in the transport clamp 4 of the adhesive binder with the back hanging out, are compressed, aligned and guided past the stitching heads 5 via guide rails 9. In the process, a light barrier 10 identifies the front and rear edges of the stack of quires 2 and the stitching heads 5 are activated, via a control unit which is not represented here, in dependence upon the running-out speed of the stacks of quires 2 and the scheduled stitching pattern, for the purpose of driving the wire staples 8 in.

Stitching is carried out in a region which is guided by the guide rails 9. To this end, apertures 9*a*, through which the stitching heads 5 can drive the wire staples 8 in, are provided in the guide rails. In the case of wire staples 8 which pass through the stack of quires 2, the bending-over device 7, which is suitably shaped for the bending-over operation, is brought up to the side of the said stack of quires 2 by the pneumatic cylinder 6 at the moment when driving-through takes place. Grooves 9*b* adjoining the apertures 9*a* permit the unhindered onward transport of stacks of quires 2 provided, in particular, with wire staples which pass through and are bent over, until the final application of pressure to the said wire staples 8 by pressure-applying rollers 11 which are applied against the stack of quires 2 in a sprung manner.

The stitching heads 5 are equipped with loading magazines 12 which can be loaded with bars 13 of wire staples even during production and permit, because of their storage volume, continuous operation without constant reloading.

In order to be able to set the distance between the stitching and the back of the stacks of quires 2, a system 14 for adjusting the stitching heads 5 in terms of height is provided. A further adjusting system 15 takes account of the different thicknesses of the stacks of quires 2 by setting the elements lying on the right-hand side in the direction of transport forwards or backwards in relation to the fixed side opposite. A pressure-regulator 16 makes it possible to set the force with which the wire staples 8 are driven into the stacks of quires 2.

The distance between two stitching actions which are executed one after the other from one side is determined by the speed of transport of the stack of quires 2 and the idle time of the stitching head 5 between two stitching actions. "Idle time" is understood to mean the time during which the stitching head 5 is being pneumatically charged for the following stitching operation. The minimum distance between two wire staples 8 which are driven in from the same side can be further reduced by using a further stitching head 5 connected in series.

It is possible to dispose the interchangeable module 1 both before and after back-machining of the stacks of quires 2. In particular, back-machining of the stacks of quires 2 connected by laterally introduced wire staples 8 to form a book block 3 is not absolutely necessary. The book blocks 3 are glued on the back, and/or on the side regions close to the back, and cased into a cover as the process in the adhesive binder continues.

A second gluing mechanism for back-gluing purposes, which is often to be encountered in adhesive binders, may be rapidly and easily exchanged for a side-stitching unit 1 as a result of the solution revealed herein. Thus it is possible to manufacture, on one machine, paper covers which are both adhesively bound and also bound by side stitching, without having to place an additional side-stitching unit equipped with its own transport system in front of the infeed to the adhesive binder for that purpose.

In general according to the invention, the velocity of the staple is in the range of 25–35 m/s; the velocity of the product is in the range of 0.5–2.5 m/s; and the thickness of the product is in the range of 2–40 mm. Under these conditions, the staple is driven into the block at an average speed that is at least ten times, preferably 25 times, the block conveying speed.

Figure 2:
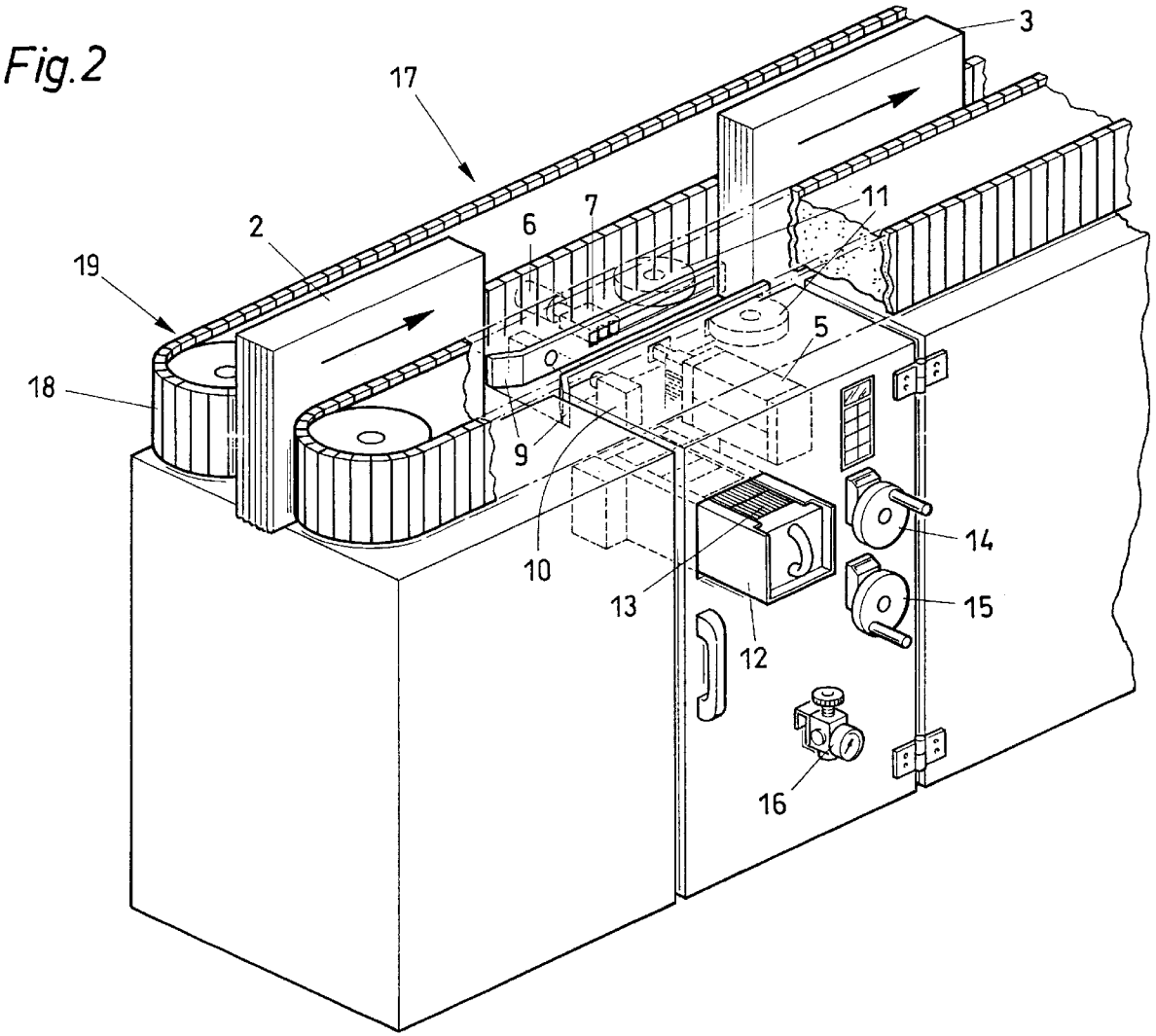
FIG. 2 shows a side-stitching station in a bookbinding machine with a circulating clamping-plate conveyer for manufacturing book blocks.

FIG. 2 shows another exemplified embodiment of the invention, in which a side-stitching station 17 with a single pneumatic stitching head 5 and a bending-over device 7 associated with the said stitching head 5 on the opposite side is used in a bookbinding machine in which stacks of quires 2 are transported forwards continuously in a conveyor chain 19 provided with clamping plates 18. It is possible to connect stacks of quires 2 of lesser thickness to form book blocks 3 by side stitching with the aid of wire staples which pass through the said stack of quires 2 and are bent over on the rear side. The stacks of quires 2 are delivered into the conveyor chain 19, at a cyclical interval which is fixed for all formats or at the smallest possible distance from one another, by an infeed which is not represented here.

The other elements in the exemplified embodiment are described in FIG. 1. In order to stitch even thick stacks of quires 2 and/or increase productive capacity, a number of stitching heads 5 are disposed in the side-stitching station 17 in a row and/or on opposite sides.

For a paper cover which may conceivably be very simple, the book block 3 is fed, as the process continues, to a slip-folding station not represented here, and is then trimmed on three sides after a brief drying period.

Figure 3:
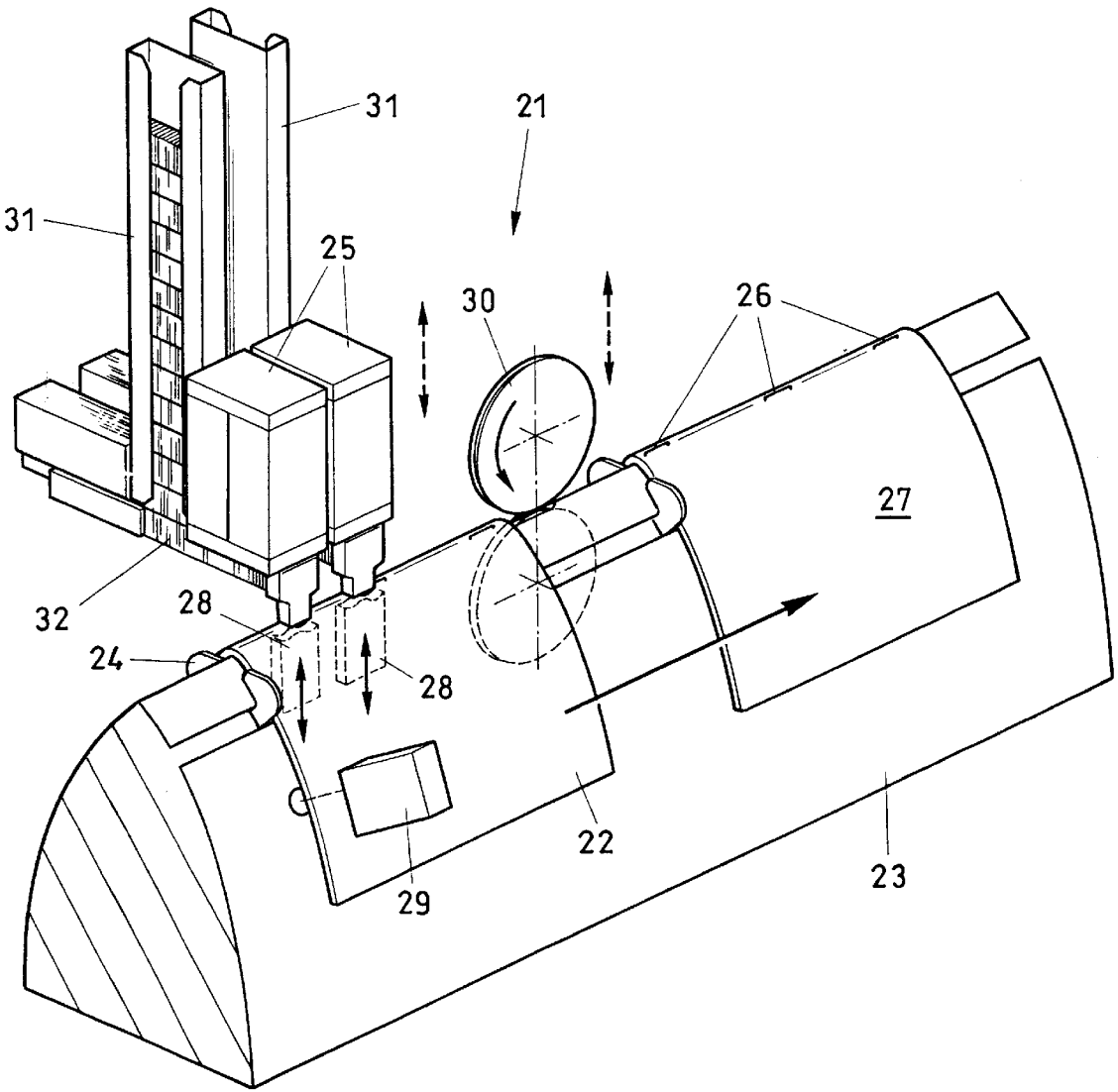
FIG. 3 shows a saddle-stitching station in a gathering wire-stitching machine.

As a further exemplified embodiment, FIG. 3 shows a gathering wire-stitching machine in which collated quires 22 are transported forwards continuously, astride a saddle-type conveyer 23, by entrainment means 24 engaging behind the said quires 22 and, while advancing, are guided past a saddle stitching station 21 positioned in a stationary manner. In the process, the quires are stitched together with wire staples 26 to form saddle-stitched paper covers 27 by stitching heads 25 which are pneumatically actuated and can be adjusted in height to the stitching thickness. The bending-over devices 28 which are necessary, for bending-over purposes, for the legs of the wire staples 26, which legs are driven through the back margin of the quires 22, are located inside the saddle-type conveyer 23 and are pressed against the inside of the quires 22 in a pneumatically actuated manner at the moment of stitching.

After the identification, by a light barrier 29, of the front and rear edges of the quires 22 to be stitched, the individual stitching heads 25 are activated separately in a manner corresponding to the stitching pattern, so that format adjustment with respect to the height of the quires 22 is eliminated. A driven pair of pressure-applying rollers, which can be set to the stitching thickness, then presses the web and bent-over legs of the wire staples 26 firmly against the stitched goods in the back-margin fold. The stitching heads 25 are provided with loading magazines 31 which make it possible to hold a large number of bars 32 of wire staples.

We claim:

1. Method for the mechanical stitching of multipart printing products by means of wire staples, in which the products are transported forward continuously in a substantially straight direction by a conveyer and a wire staple is driven into the product by a stitching head with a displaceably guided staple-driver, wherein the improvement comprises that:

at least one wire staple is driven, during the continuous forward movement of the conveyed product, into said product, transversely to the direction of conveyance, by a stitching head positioned in a stationary manner as the product moves past the stitching head, and the staple-driver of the stitching head drives in the wire staple at such high speed that said wire staple penetrates the product substantially perpendicularly.

2. Method according to claim 1, wherein the improvement comprises that U-shaped wire staples are separated from bars of staples in a magazine belonging to the stitching head and are driven into the product.

3. Method according to claim 1, wherein the improvement comprises that a wire is drawn off from a supply reel, cut to length and shaped into a U-shaped wire staple, and is driven into the product.

4. Method according to claim 1, wherein the improvement comprises that sheets or quires collated to form a block are transported forward while held in a clamped manner, the wire staples have leg portions driven into the product from one side of the product, and the legs of the wire staples are bent over on the opposite side of the product.

5. Method according to claim 1, wherein the improvement comprises that sheets or quires collated to form a block having a block thickness are transported forward while held in a clamped manner and wire staples having leg portions are driven into the product from opposite sides so as to engage in one another, the lengths of the legs of the wire staples being smaller than the thickness of the block.

6. Method according to claim 1, wherein the improvement comprises that individual or collated quires (22) having a back margin are transported forward astride a saddle-type conveyer (23), wire staples (26) having legs are driven into the back margin of the quires (22), and the legs of the wire staples (26) are bent over on the opposite side of the quires (22).

7. Method for the mechanical stitching of multipart printing products by means of wire staples, in which the products are transported forward continuously by a conveyer and a wire staple is driven by a stitching head with a displaceably guided staple-driver, wherein the improvement comprises that:

at least one wire staple is driven, during the movement of the conveyed product, into said product, transversely to the direction of conveyance, by a stitching head positioned in a stationary manner, the staple-driver of the stitching head drives in the wire staple at such high speed that said wire staple penetrates the product substantially perpendicularly, and the staples are driven into the product at an average speed that is at least about ten times the conveying speed of the product.

8. Method according to claim 7, wherein the improvement comprises that the staples are driven into the product at an average speed that is in the range of about 10–25 times the conveying speed of the product.

9. In a device for the mechanical stitching of multipart printing products by means of wire staples, in which the products are transported forward continuously in a plane of transport by a conveyer toward a stitching unit, and the stitching unit with at least one stitching head drives staples into the product, the improvement comprising that the stitching head:

is orientated perpendicularly to the plane of transport, is positioned in a stationary manner at a defined distance from the products, has a magazine for holding bars of staples and has a displaceably guided staple-driver, for driving in wire staples perpendicularly to the plane of transport during the forward transport of the product past the stitching head.

10. Device according to claim 9, wherein the improvement comprises a compressed-air controller for the staple-driver whereby the driving-in force can be set by adjusting the compressed air with a pressure-regulator.

11. Device according to claim 9, wherein the improvement comprises that the driving-in force can be set by altering the distance of the stitching head from the product.

12. Device according to claim 9, wherein the wire staples have legs and the improvement comprises that an apparatus for bending over the legs of the wire staples is associated with the stitching head.

13. Device according to claim 9, wherein the improvement comprises that a stitching head belonging to the stitching unit includes means sequentially activatable for driving two or more wire staples into one product.

14. Device according to claim 9, wherein the improvement comprises means associated with two or more stitching heads belonging to the stitching unit for activating the heads separately from one another for the purpose of driving in the wire staples in a manner adapted to the stitching pattern and the height of the product.

15. Device according to claim 9, wherein the improvement comprises at least one guide rail which, in the stitching region, compresses the products, aligns them and guides them past the stitching head.

16. Device according to claim 9, wherein the improvement comprises at least one pressure-applying roller which is disposed after the stitching head and presses the driven-in wire staples firmly against the products.

17. Device according to claim 9, wherein the improvement comprises a height-adjusting system which sets the distance between the wire staples which are driven into the products from the side, and the back of the products.

18. Device according to claim 9, wherein the improvement comprises that at least one staple magazine, loadable during production, is associated with the stitching head for automatically feeding in bars of staples.

19. Device according to claim 9, wherein the improvement comprises that the stitching unit (1, 17, 21) is a saddle stitching station (21) for a gathering wire-stitching machine having a circulating gathering chain provided with entrainment means (24).

20. In a device for the mechanical stitching of multipart printing products by means of wire staples, in which the products are transported forward continuously in a plane of transport by a conveyer, and a stitching unit with at least one stitching head drives staples into the product, the improvement comprising that the stitching head:

is orientated perpendicularly to the plane of transport, is positioned in a stationary manner at a defined distance from the products, has a magazine for holding bars of staples, has a displaceably guided staple-driver, for driving in wire staples perpendicularly to the plane of transport, and the staple driver drives the staples into the product at an average speed that is at least ten times the conveying speed of the product.

* * * * *

UNITED STATES PATENT AND TRADEMARK OFFICE

CERTIFICATE OF CORRECTION

PATENT NO. : 7,121,540 B2
APPLICATION NO. : 09/930647
DATED : October 17, 2006
INVENTOR(S) : Machon et al.

It is certified that error appears in the above-identified patent and that said Letters Patent is hereby corrected as shown below:

Column 5:

Line 27, after "quires" delete "(22)".

Line 29, after "conveyor" delete "(23)".

Line 29, after "staples" delete "(26)".

Line 30, after "quires" delete "(22)".

Line 31, after "staples" delete "(26)".

Line 32, delete "(22)".

Signed and Sealed this

Fourth Day of September, 2007

JON W. DUDAS
*Director of the United States Patent and Trademark Office*